US005518058A

United States Patent [19]

Gastmann

[11] Patent Number: 5,518,058

[45] Date of Patent: May 21, 1996

[54] CURTAIN-RAIL SLIDE

[75] Inventor: Günter Gastmann, Essen, Germany

[73] Assignee: Cedargrove Limited, Gibraltar

[21] Appl. No.: 320,156

[22] Filed: Oct. 7, 1994

[30] Foreign Application Priority Data

Oct. 12, 1993 [DE] Germany ..... 43 34 717.7

[51] Int. Cl.[6] ..... A47H 1/00

[52] U.S. Cl. ..... 160/330; 16/87.6 R; 16/930; 160/345

[58] Field of Search ..... 160/330, 345, 160/346; 16/93 R, 87.4 R, 87.6, 93 D, 94 D, 95 R, 95 D, 96 D

[56] References Cited

U.S. PATENT DOCUMENTS

| | | | |
|---|---|---|---|
| 3,090,431 | 5/1963 | Stubblefield | 160/345 |
| 3,142,858 | 8/1964 | Bieda | 160/346 X |
| 3,157,907 | 11/1964 | Stall | 160/345 X |
| 3,359,592 | 12/1967 | Saltz . | |
| 3,587,131 | 6/1971 | Graf | 160/345 X |
| 4,240,178 | 12/1980 | Miki | 160/345 X |

FOREIGN PATENT DOCUMENTS

| | | | |
|---|---|---|---|
| 2216323 | 10/1973 | Germany . | |
| 3635422 | 4/1987 | Germany | 16/93 D |
| 4238455 | 5/1994 | Germany . | |

*Primary Examiner*—Philip C. Kannan
*Attorney, Agent, or Firm*—Herbert Dubno; Andrew Wilford

[57] ABSTRACT

A tubular rail formed with a longitudinally extending and downwardly open slot of predetermined width is provided with a plurality of curtain slides spaced along the rail and each having a body and a core. The body is formed with a pair of horizontally oppositely projecting wings extending perpendicular to the rail and with a V-shaped loop underneath the rail engaged through the curtain upper edge. The core is formed with a T-shaped head normally engaged in the rail and of a width greater than the slot width and a thickness less than the slot width. The head is pivotal between a holding position in the rail perpendicular thereto and a freeing position parallel to the slot. A spring is braced between the body and the core and urges the head into the holding position. An arm projects transversely from and is fixed rotationally to the head so that the head can be rotated into the freeing position by means of the arm. In addition the body is formed at one longitudinal end with a longitudinally projecting plug and at its opposite longitudinal end with a socket complementary to and opening longitudinally opposite to the plug so that when the bodies are pushed longitudinally together the plug of one body will engage in the socket of an adjacent body.

14 Claims, 6 Drawing Sheets

CURTAIN-RAIL SLIDE

FIELD OF THE INVENTION

The present invention relates to a slide for supporting a curtain in a rail. More particularly this invention concerns such a slide which is adapted to be slipped with the curtain out of the rail to move or replace the curtain.

BACKGROUND OF THE INVENTION

It is known to fit the edge of a curtain with a plurality of like slides that can move along a rail so that the curtain can be opened and closed. Such a rail typically is tubularly hollow, of generally square cross section, and is formed with a longitudinally extending and downwardly open slot. The slides ride inside the rail and project downward through the slot where they are provided with loops from which the curtain is hung.

When such a curtain must be removed it is either necessary to unclip it from each of its slides, or to slip all the slides out the end of the rail while still attached to the curtain. Both operations are onerous. German patent document 2,216,323 describes a system which somewhat eases this operation, but that still could stand improvement.

OBJECTS OF THE INVENTION

It is therefore an object of the present invention to provide an improved slide for a curtain rail.

Another object is the provision of such an improved slide for a curtain rail which overcomes the above-given disadvantages, that is which makes it easy to remove the curtain from the rail and reinstall it thereon.

SUMMARY OF THE INVENTION

According to the instant invention a tubular rail formed with a longitudinally extending and downwardly open slot of predetermined width is provided with a plurality of curtain slides spaced along the rail and each having a body and a core. The body is formed with a pair of horizontally oppositely projecting wings extending perpendicular to the rail and with a V-shaped loop underneath the rail engaged through the curtain upper edge. The core is formed with a T-shaped head normally engaged in the rail and of a width greater than the slot width and a thickness less than the slot width. The head is pivotal between a holding position in the rail perpendicular thereto and a freeing position parallel to the slot. A spring is braced between the body and the core and urges the head into the holding position. An arm projects transversely from and is fixed rotationally to the head so that the head can be rotated into the freeing position by means of the arm. In addition the body is formed at one longitudinal end with a longitudinally projecting plug and at its opposite longitudinal end with a socket complementary to and opening longitudinally opposite to the plug so that when the bodies are pushed longitudinally together the plug of one body will engage in the socket of an adjacent body.

Thus with this system the core head can be pivoted to the side to allow the slide to be taken out of the rail. It does not need to be shifted to the end to be removed. In addition the interfitting sockets and plugs ensure that a plurality of such slides can be removed as a single unit that is interconnected so it takes up minimal space and is very easy to handle. A tool such as described in German published application 4,238,455 can be used for such removal. Normally the loop is connected to the curtain in two longitudinally offset locations, typically by passing through two adjacent holes. Thus as the curtain is stretched the slides will automatically center and space themselves uniformly.

The projection according to the invention can have a plurality of fingers and be a snap fit in the socket of another such slide body. This makes the slides hold together in a very stable assembly.

The core in accordance with the invention is further formed with a shaft carrying the head, pivotal about an upright axis in the body, and limitedly axially movable in the body and is urged axially by the spring into one of a pair of end positions, and with a formation cooperating with a formation on the body and normally retaining the head in the holding position. The formations are disengageable with each other on displacement of the shaft into the other of the end positions. Normally the formations include a groove and a ridge engageable therein. In addition according to the invention the core includes a sleeve fixed in the body and centered on an axis and a shaft rotationally and axially displaceable in the sleeve and formed with the T-head and arm. The spring is in the sleeve and engages the shaft. The force of the spring can be adjusted. Such an arrangement ensures that the slides will not come intentionally loose, as only a concerted effort will disengage the formations to allow the core head to turn and release the slide from the rail. To keep the slide aligned with the rail it is formed with an upwardly extending and longitudinally elongated part or yoke that engages over the core.

The loop can lie generally in a plane parallel to the rail or it can lie generally in a plane forming a small acute angle with the rail. With the latter system the loop can extend longitudinally past the body, but when the bodies abut longitudinally they will overlay and not interfere with one another.

For best centering of the slides the loop has a pair of straight sides that extend upward away from each other and normally the loop passes though two portions of the curtain, that is through two spaced grommets or holes. One of the sides can be releasably hooked on the body and each side can have a straight upper portion and a straight lower portion with the upper portions diverging from each other at a greater angle than the lower portions. This ensures that when the curtain is pulled all the way open, it will ride up somewhat and will not leave a gap between the upper curtain edge and the lower edge of the rail.

Normally according to the invention the core is generally wholly made of steel and the body is generally wholly made of plastic.

BRIEF DESCRIPTION OF THE DRAWING

The above and other objects, features, and advantages will become more readily apparent from the following description, reference being made to the accompanying drawing in which.

SPECIFIC DESCRIPTION

Figure 6:
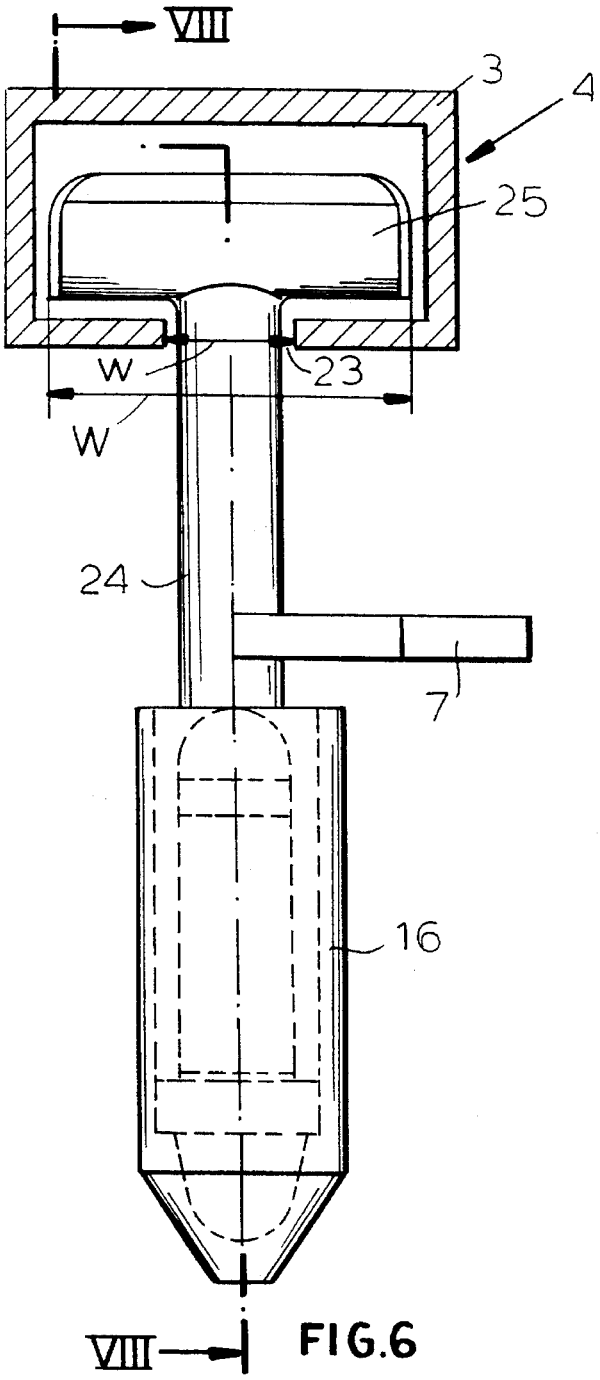
FIG. 6 is a large-scale side view of the core part of the curtain slide of this invention.

As seen in FIGS. 1 through 8 a curtain assembly according to this invention comprises a plurality of identical hangers or slides 1 from which hangs a curtain 2 and which ride in a rail 3 extending horizontally along axis L. Each slide 1 has a steel core 4 surrounded by a molded plastic body 5. The rail 3 as best seen in FIG. 6 is tubular, of generally square section, and formed with a downwardly open full-length slot 23 of a predetermined transverse width W. The rail can be provided with magnetic end position holders that coact with magnetically attractable portions of the slides 1.

As best seen in FIGS. 1*a*, 2, 3, 4, and 5, the body 5 is centered on an upright axis A and has a central vertical passage 15 in which the core 4 tightly fits, and a pair of lateral wings or vanes 8 that extend horizontally perpendicular to the axes L and A and that ride against or slightly below the bottom surface of the rail 3. At one longitudinal (relative to axis L) end the body 5 is formed with an outwardly projecting plug 11 and at its opposite side it is formed with a complementarily shaped but oppositely directed socket 12. An upper part 13 of the body 5 is formed on the axis A with a downwardly open and transversely extending groove 14 into which fits a ridge (FIG. 8) 26 formed on the top of the core 4. An integral curtain loop 9 of V-shape is formed on the bottom of the body 5 and can be opened at one end 22 to engage through grommets on the curtain 2, normally through two adjacent grommets, and to snap into a seat 21 on the body 1. The sides of the loop 8 are straight and each extend at 30° to the axis A.

Figure 8:
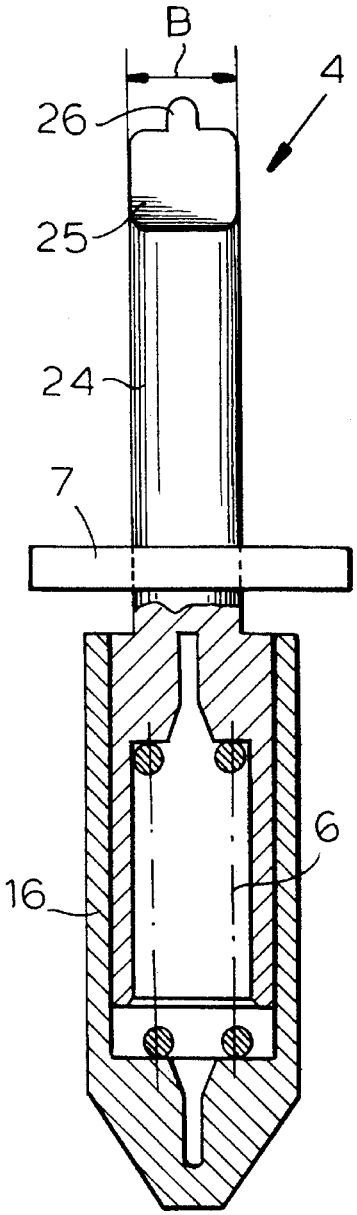
FIG. 8 is a side and partly sectional view partly taken along line VIII—VIII of FIG. 6.
Figure 7:
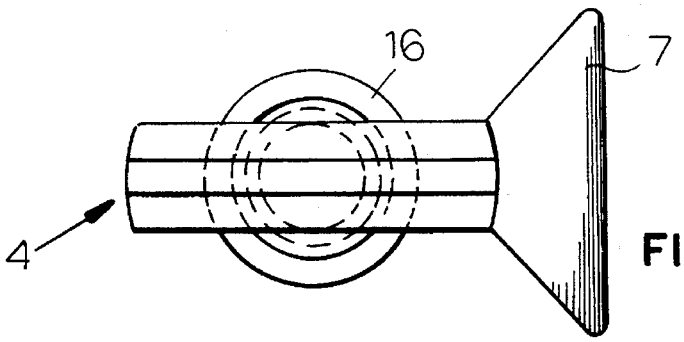
FIG. 7 is a top view of the core part of FIG. 6.
Figure 9:
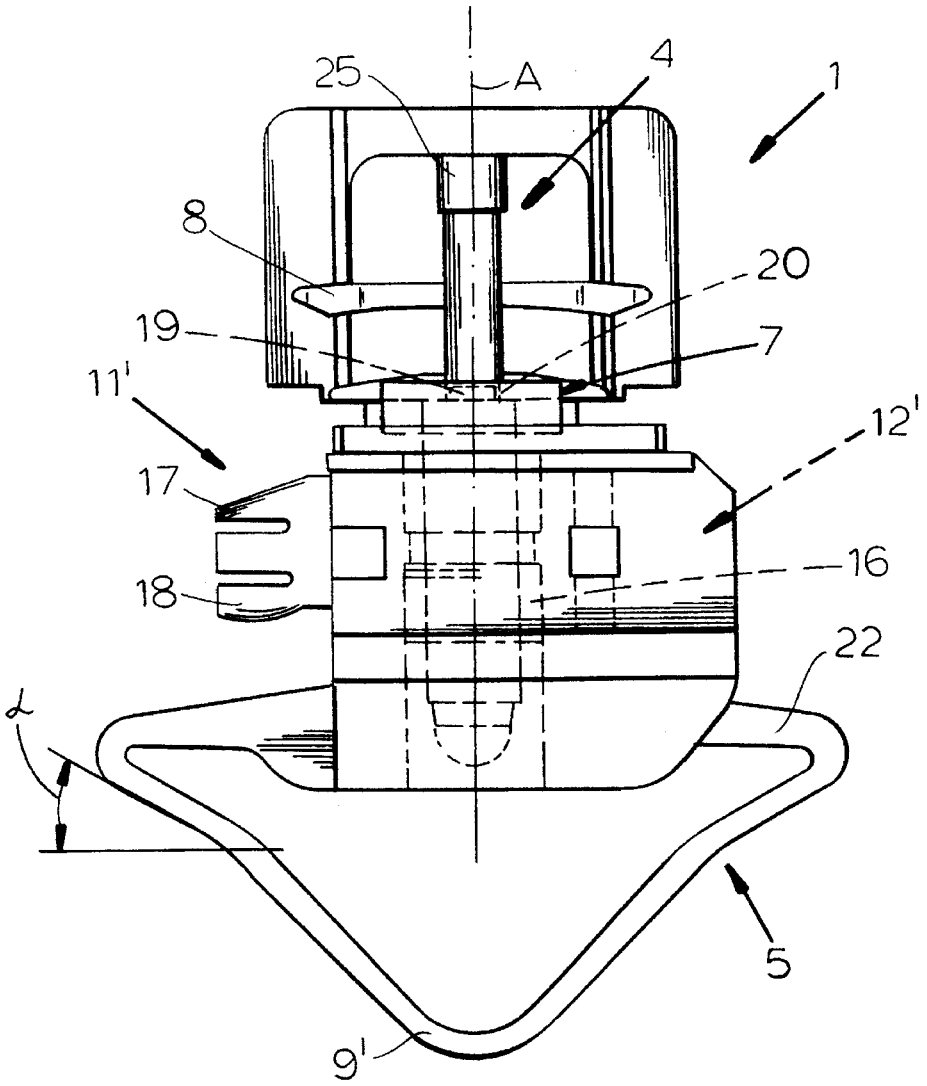
FIGS. 9 and 10 are side and top views, respectively, of the core part of another slide according to the invention.
Figure 10:
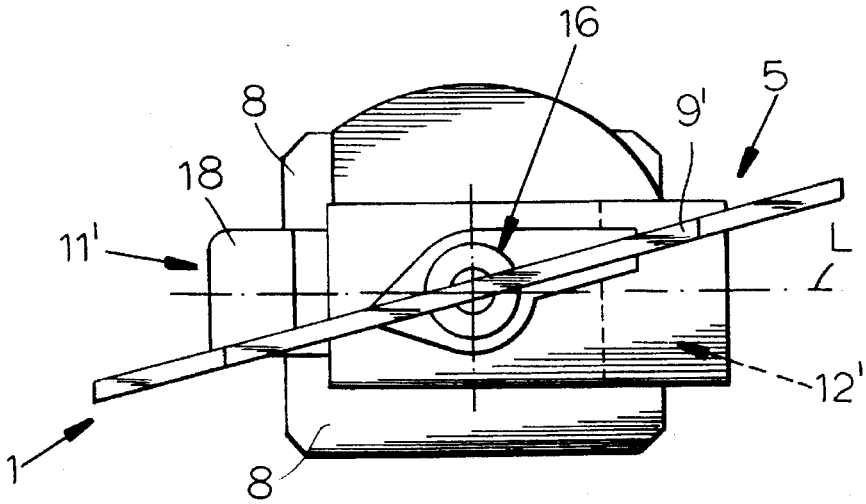
Figure 11:
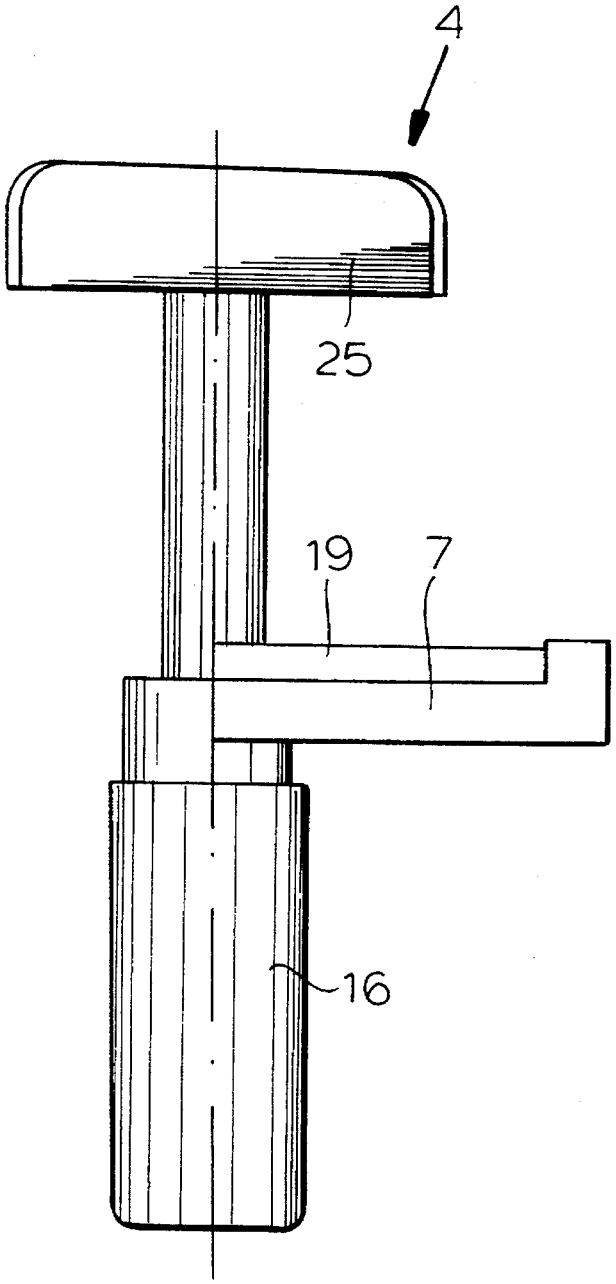
FIGS. 11 and 12 are side views taken from 90°-offset vantage points of the core part of the slide of FIGS. 9 and 10.
Figure 12:
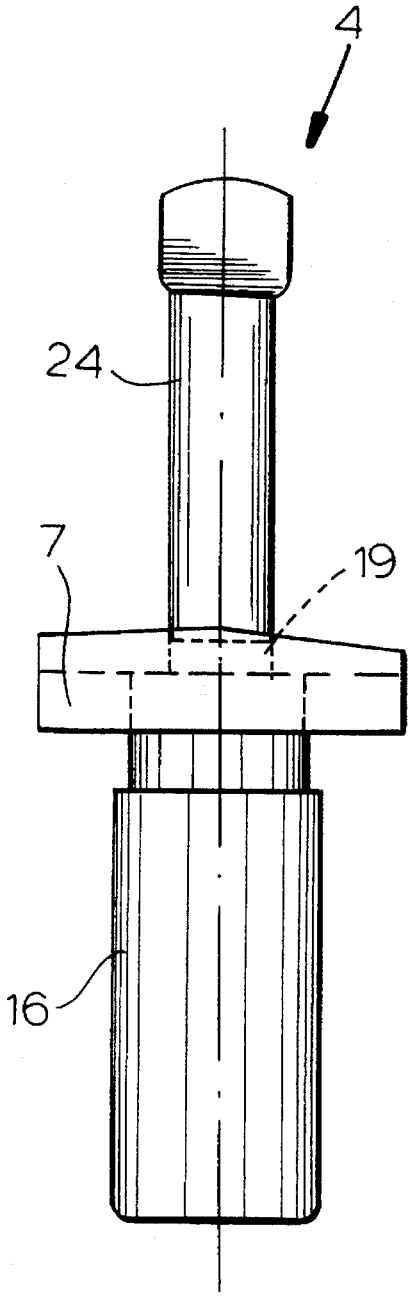

This core 4 as seen in FIGS. 6 through 8 has a cylindrical steel shaft 24 with a T-shaped head 25 and a lower end that is axially and angularly displaceable in a sleeve 16, but that is braced therein by an adjustable-force spring 6 which retains it in one angular position and urges it upward. The shaft 24 is formed with a radially projecting actuating arm 7 and can pivot from the illustrated position through about 90°. The sleeve 16 is normally gripped in the hole 15 of the body 5 so that the arm 7 and head 25 both normally extend perpendicular to the axis L. The head 25 has a thickness equal to a diameter B of the shaft 24 which is slightly less than the width w of the rail slot 23, and the head 25 has a width W which is substantially greater than the width w. Thus when the head 25 is crosswise in the rail 3 the respective slide 1 will be suspended from this rail 3 and will be able to slide longitudinally along it. When the head 25 is parallel to the slot 23, it can move down out of the rail 3.

Figures 1, 1A:
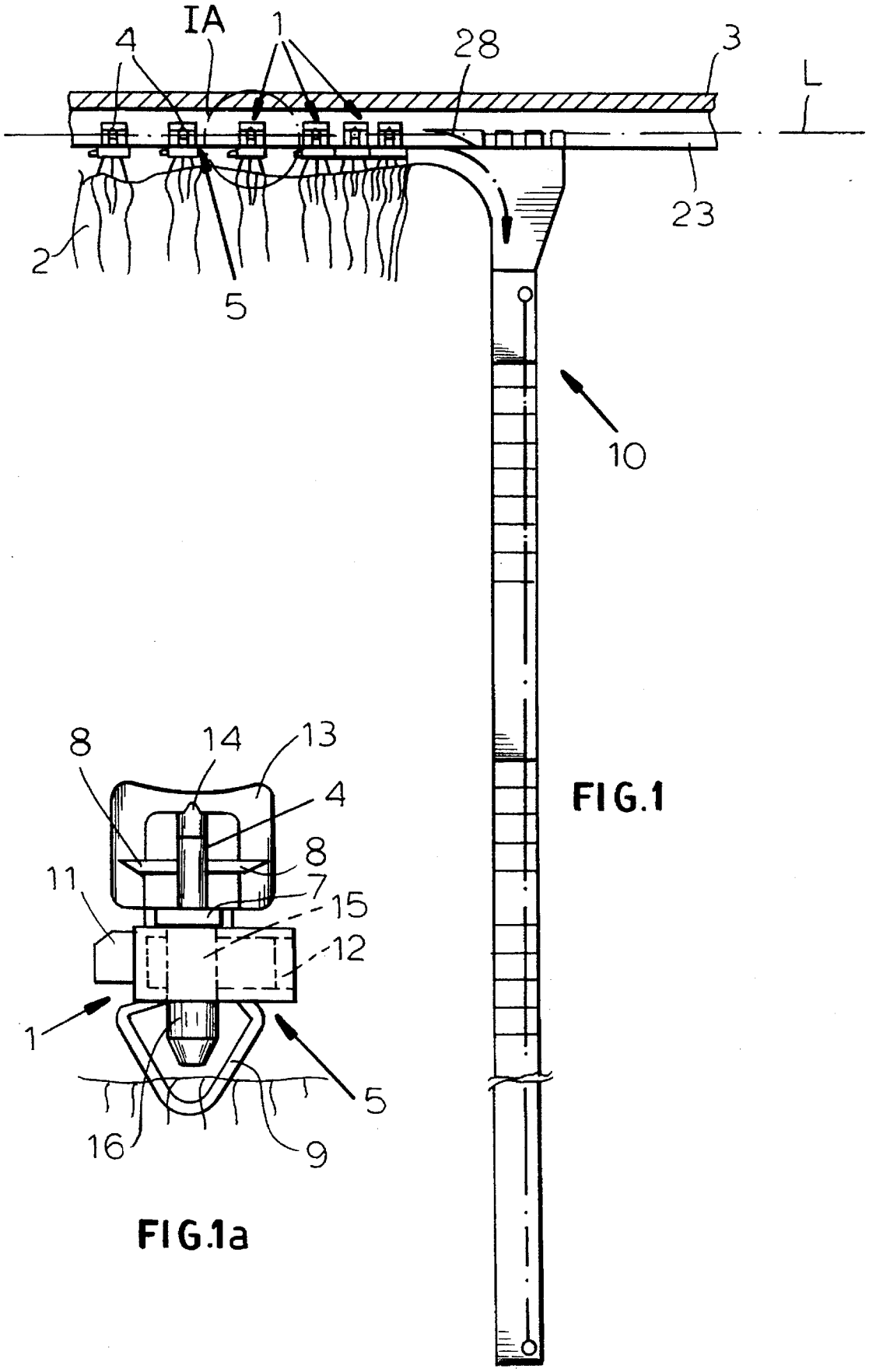
FIG. 1 is a small scale side view of a curtain and its mounting assembly and changing device according to the invention.
FIG. 1*a* is a large-scale view of the detail indicated at 1*a* in FIG. 1.
Figure 2:
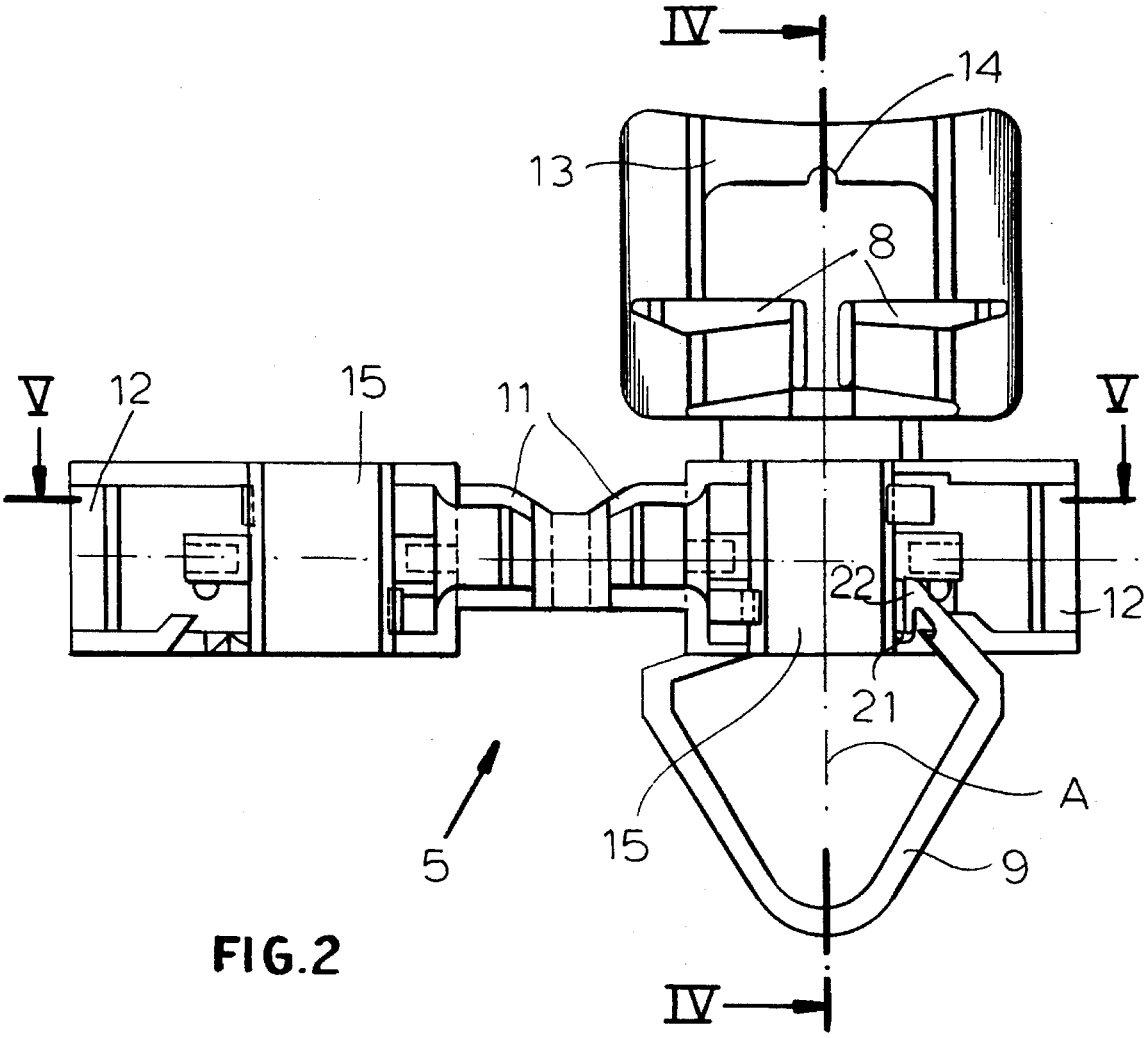
FIG. 2 is a side view of the body part of the curtain slide in open condition.
Figure 3:
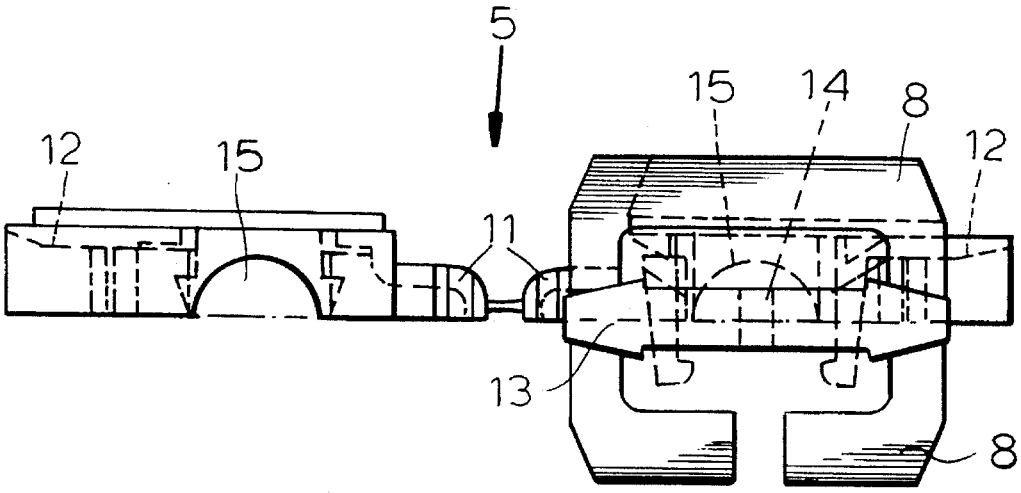
FIG. 3 is a top view of the opened curtain slide of FIG. 2.
Figure 4:
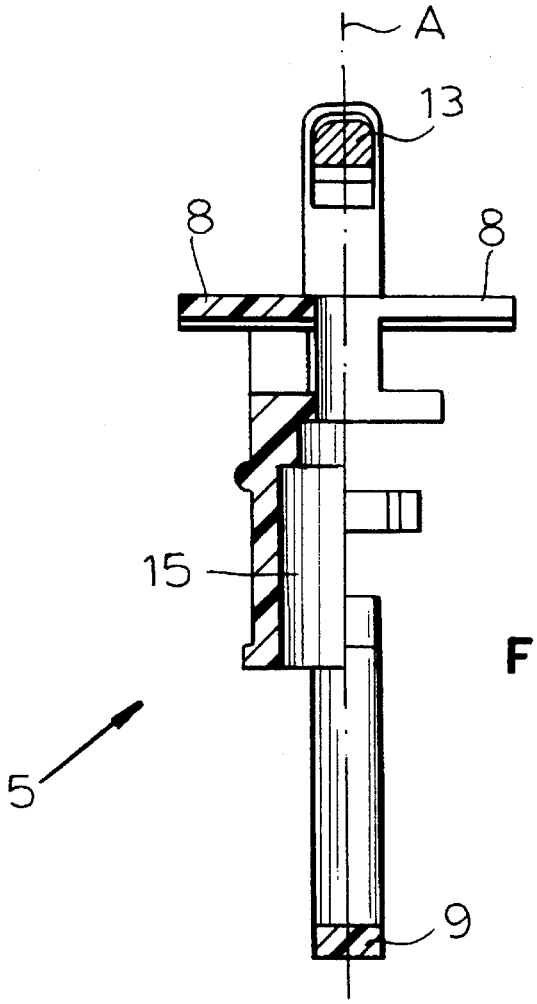
FIGS. 4 and 5 are sections respectively taken along lines IV—IV and V—V of FIG. 2.
Figure 5:
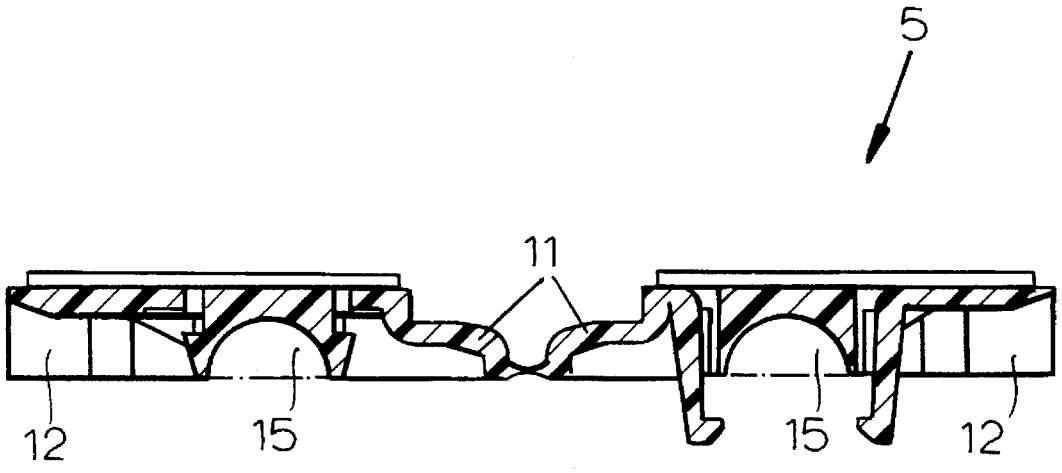

As seen in FIG. 1 a drape-changing tool 10 as described in German patent document 4,238,455 can be fitted to the rail 3 and has a cam 28 that can engage the arms 7. Thus when a curtain 2 is to be removed, the tool 10 is fitted to the rail 3 at the end and the curtain and the slides 1 are pushed toward the tool 10. The vanes or wings 8 fit into grooves in a track in the tool 10 and the arm 7 is engaged by the cam 28 to pivot the shaft 24 and head 25 through 90°, allowing the slides 1 to pull out of the rail 3. The plugs 11 will fit in the adjacent sockets 12 to form a very compact assembly. The removed curtain 2 can be reinstalled simply by fitting the tool 10 to the rail 3 and pushing it out again, with the heads 25 automatically pivoting back into the crosswise holding position as they leave the tool 10.

In the arrangement of FIGS. 9 through 12 the loop 9' is in a plane lying at a small acute angle to the axis L and projects axially well past the ends of the body 5. Thus when the bodies 5 are pushed together these loops 9' will overlap but not interfere with each other. The upper region of each leg or side of the V-shaped loop 9' is bent out at a flat angle $\alpha$ of about 30° to the horizontal.

The plug 11' here is formed with three fingers 17 and a retaining formation 18 to snap-fit in a complementarily formed socket 12'. Furthermore the arm 7 is formed along its upper edge with a rectangular-section ridge 19 that fits in a complementary notch 20 formed in the body 5 to releasably retain the core 4 in the perpendicular position. As in the other embodiment, when the shaft 24 is pushed down, the formations 19 and 20 disengage to permit the shaft 24 to turn in the sleeve 16 against the force of the spring 6.

I claim:

1. In combination with a curtain having an upper edge and with a tubular rail formed with a longitudinally extending and downwardly open slot of predetermined width, a plurality of curtain slides spaced along the rail and each comprising:

a body formed with a pair of horizontally oppositely projecting wings extending perpendicular to the rail, and a V-shaped loop underneath the rail connected to the curtain upper edge; and a core secured in the body and formed with a T-shaped head normally engaged in the rail and of a width greater than the slot width and a thickness less than the slot width, the head being pivotal between a holding position in the rail perpendicular thereto and a freeing position parallel to the slot, spring means braced between the body and the core and urging the head into the holding position, and an arm projecting transversely and rotationally fixed to the head, whereby the head can be rotated into the freeing position by means of the arm.

2. In combination with a curtain having an upper edge and with a tubular rail formed with a longitudinally extending and downwardly open slot of predetermined width, a plurality of curtain slides spaced along the rail and each comprising:

a body formed with a pair of horizontally oppositely projecting wings extending perpendicular to the rail, a V-shaped loop underneath the rail connected to the curtain upper edge, a longitudinally projecting plug, and a socket complementary to and opening longitudinally opposite to the plug, whereby when the bodies are pushed longitudinally together the plug of one body will engage in the socket of an adjacent body; and a core secured in the body and formed with a T-shaped head normally engaged in the rail and of a width greater than the slot width and a thickness less than the slot width, the head being pivotal between a holding position in the rail perpendicular thereto and a freeing position parallel to the slot, spring means braced between the body and the core and urging the head into the holding position, and an arm projecting transversely and rotationally fixed to the head, whereby the head can be rotated into the freeing position by means of the arm.

3. The curtain-hanger slide defined in claim 2 wherein the plug has a plurality of fingers and is a snap fit in the socket of another such slide body.

4. The curtain-hanger slide defined in claim 1 wherein the core is further formed with a shaft carrying the head, pivotal about an upright axis in the body, and limitedly axially movable in the body and being urged axially by the spring means into one of a pair of end positions, and a formation cooperating with a formation on the body and normally retaining the head in the holding position, the formations being disengageable with each other on displacement of the shaft into the other of the end positions.

5. The curtain-hanger slide defined in claim 4 wherein the formations include a groove and a ridge engageable therein.

6. The curtain-hanger slide defined in claim 5 wherein the ridge is formed on the head and the groove on the body.

7. The curtain-hanger slide defined in claim 5 wherein the ridge is formed on the arm and the groove on the body.

8. The curtain-hanger slide defined in claim 1 wherein the core includes:

a sleeve fixed in the body and centered on an axis, and a shaft rotationally and axially displaceable in the sleeve and formed with the T-head and arm, the spring means being in the sleeve and engaging the shaft.

9. The curtain-hanger slide defined in claim 1 wherein the loop lies generally in a plane parallel to the rail.

10. The curtain-hanger slide defined in claim 1 wherein the loop lies generally in a plane forming a small acute angle with the rail.

11. The curtain-hanger slide defined in claim 1 wherein the loop has a pair of straight sides that extend upward away from each other.

12. The curtain-hanger slide defined in claim 11 wherein one of the sides can be releasably hooked on the body.

13. The curtain-hanger slide defined in claim 11 wherein each side has a straight upper portion and a straight lower portion and the upper portions diverge from each other at a greater angle than the lower portions.

14. The curtain-hanger slide defined in claim 1 wherein the core is generally wholly made of steel and the body is generally wholly made of plastic.

* * * * *